US005425505A

United States Patent [19]

Jones

[11] Patent Number: 5,425,505

[45] Date of Patent: Jun. 20, 1995

[54] PORTABLE GROUND STANDING FIRE FIGHTING MONITOR

[76] Inventor: Jerry D. Jones, Rte. 2, Box 4, Graham, Tex. 76450

[21] Appl. No.: 135,787

[22] Filed: Oct. 13, 1993

[51] Int. Cl.[6] ..... A62C 31/28; B05B 15/06

[52] U.S. Cl. ..... 239/276; 169/52; 239/587.1

[58] Field of Search ..... 169/51, 52, 24, 25, 169/70; 239/273, 276, 525, 587.1, 587.2, 587.5, 590, 590.3, 590.5

[56] References Cited

U.S. PATENT DOCUMENTS

| | | | |
|---|---|---|---|
| 1,451,006 | 4/1923 | Blaw | 169/25 X |
| 1,583,772 | 5/1926 | Blaw | 169/25 X |
| 2,984,422 | 5/1961 | Vogt et al. | 169/25 X |
| 4,392,618 | 7/1983 | Evans et al. | 239/461 |
| 4,506,738 | 3/1985 | Evans et al. | 169/24 |
| 4,674,686 | 6/1987 | Trapp | 239/587.3 |
| 4,793,557 | 12/1988 | Marchese et al. | 239/587.3 |
| 5,135,055 | 8/1992 | Bisson | 169/70 X |

*Primary Examiner*—Andrew C. Pike

*Attorney, Agent, or Firm*—John R. Flanagan

[57] ABSTRACT

A portable ground standing fire fighting monitor includes a support platform intended to be placed horizontally on the ground surface, a water gun with a curved flexible inlet tube having an inlet end and a curved discharge head having an outlet end, a water-tight ball-bearing swivel joint coupling the discharge head to the curved flexible inlet tube, and an adjustable bracket assembly, a crank wheel, and a threaded rod and ball joint connector coupling the flexible inlet tube on the support platform. By rotating the crank wheel and the threaded rod and ball joint connector therewith, relative to the bracket assembly and flexible inlet tube, the flexible inlet tube and discharge head therewith can be adjusted to varying inclinations thereby allowing the operator to adjust stream flow direction vertically. By pivoting a swivel handle connected to the discharge head adjacent to the swivel joint, the discharge head can be swivelled from side to side thereby allowing the operator to adjust stream flow direction horizontally.

20 Claims, 2 Drawing Sheets

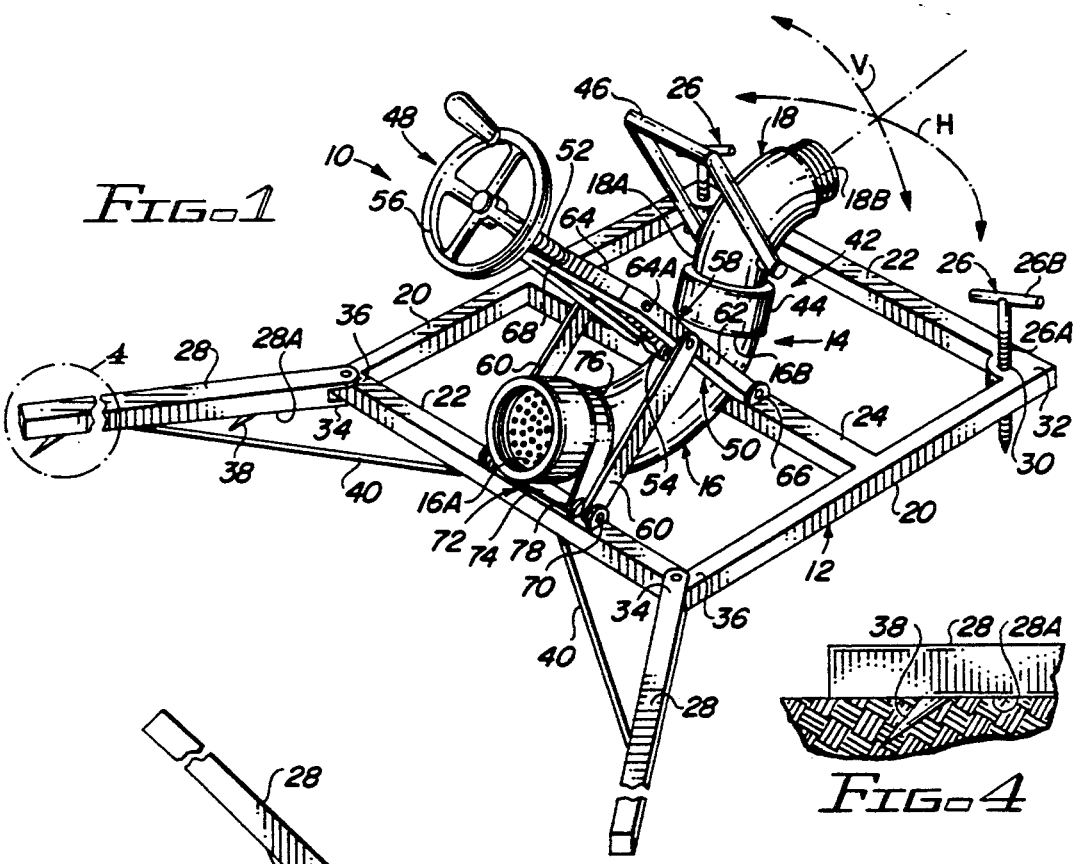
FIG. 1
FIG. 4
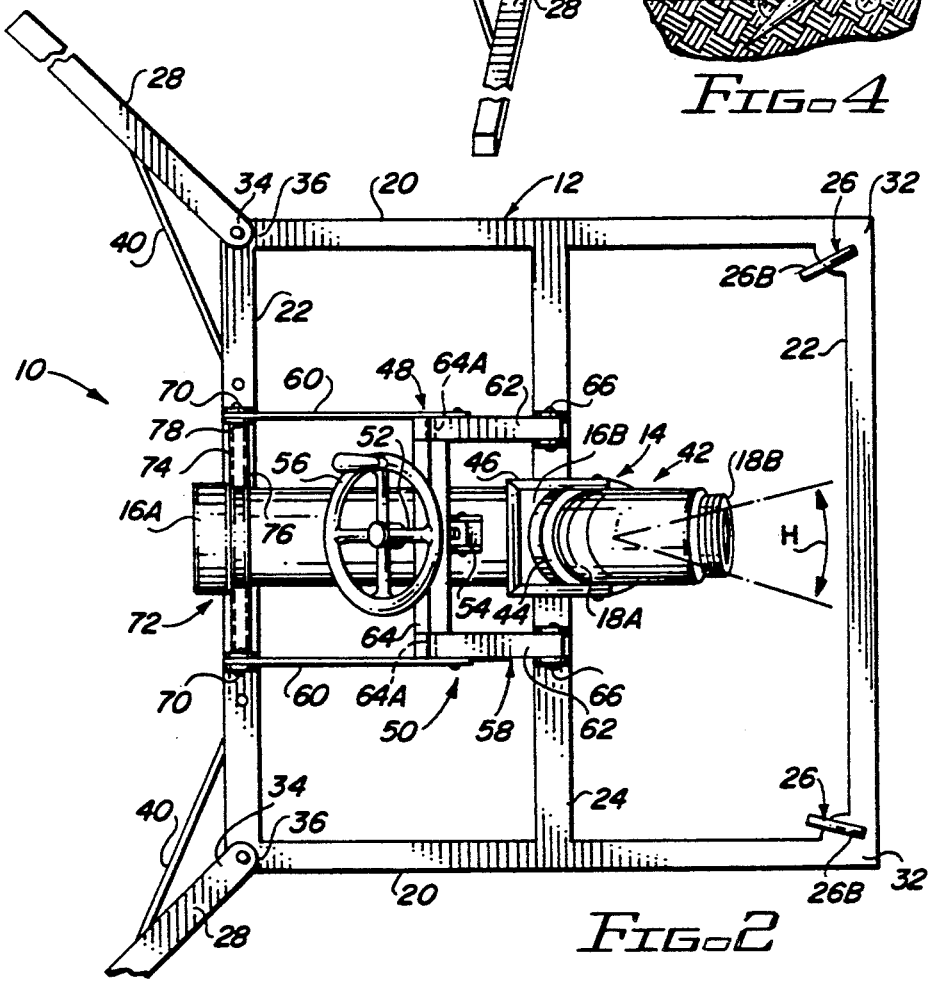
FIG. 2

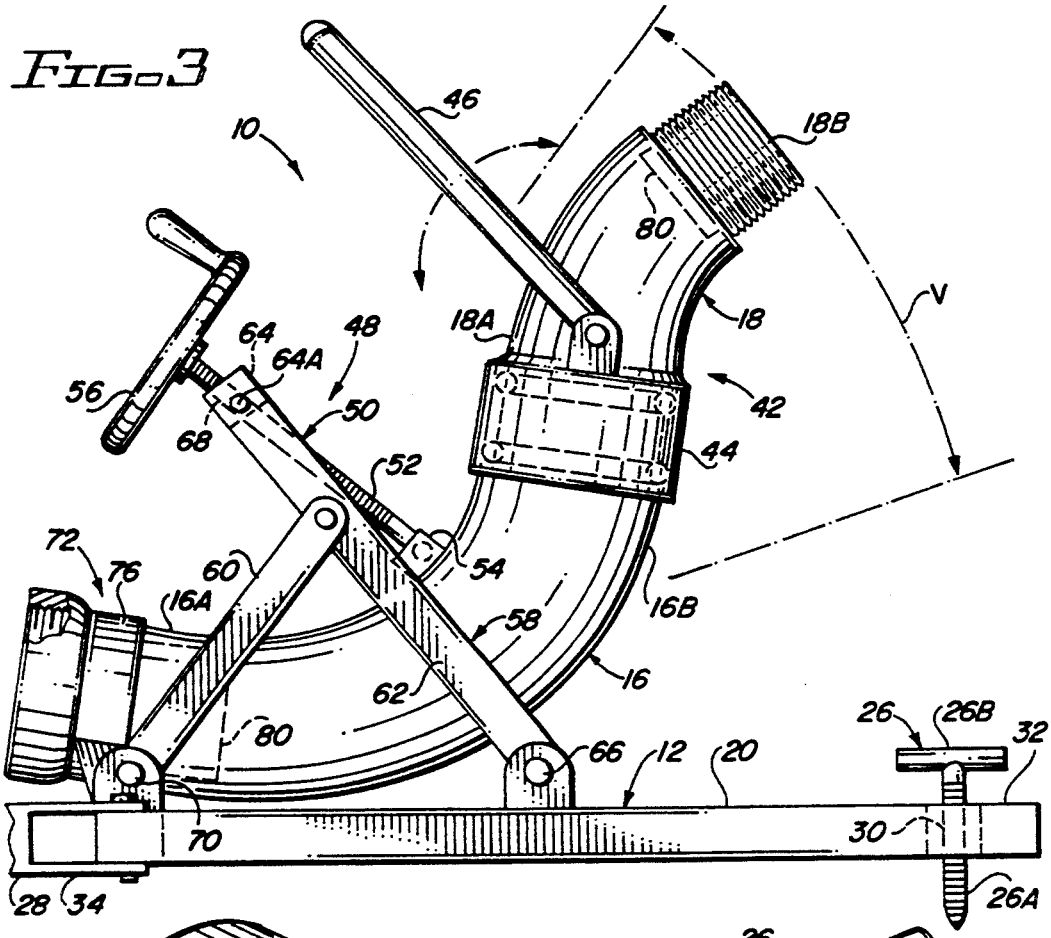
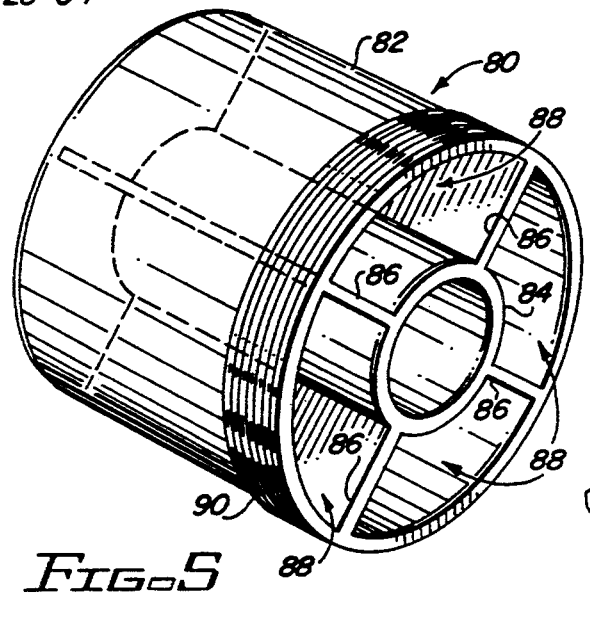
FIG. 5
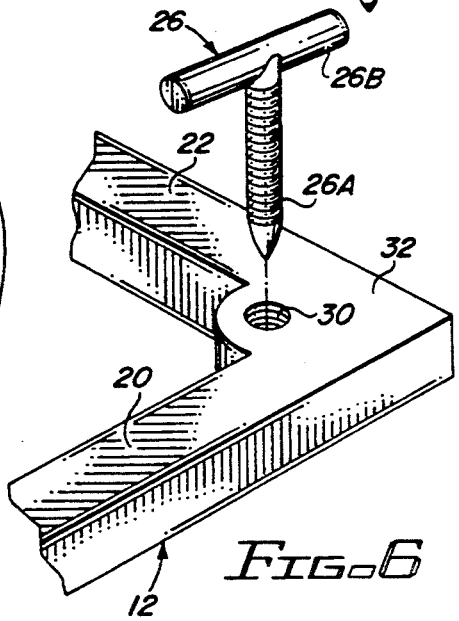
FIG. 6

PORTABLE GROUND STANDING FIRE FIGHTING MONITOR

BACKGROUND OF THE INVENTION

1. Field of the Invention

The present invention generally relates to a fire fighting monitor for aiming and projecting a stream of water and more particularly to a lightweight, portable, and inexpensive ground standing fire fighting monitor.

2. Description of the Prior Art

Fire fighting monitors are the artillery pieces used by fire fighters while fighting a blaze. They generally comprise a directionally controllable water gun mounted on a secure base. Often, they are deployed to a position within range of the fire, attached to a high pressure water source, and then aimed so that they can project a stream of water at a desired target.

U.S. Pat. No. 4,674,686 issued to Trapp and U.S. Pat. Nos. 4,392,618 and 4,506,738 issued to Evans et al. exemplify prior art fire fighting monitors. Trapp discloses a monitor having a base which supports two elbow pipes having rotating joints that are manipulated by crank actuated worm gears. Evans discloses monitors which include a discharge head having a ball shaped body that seats in a hollow socket which, in turn, is supported by a base. In Evans, water flows up through the base, into the hollow socket, into and out through the pivotable and rotatable head. In both cases, expensive, relatively heavy, precision machined components are needed to construct a workable monitor. Trapp requires precision worm-gear elements along with several precision bearings. Evans requires a difficult, machined watertight spherical ball and socket assembly of significant diameter. While these prior art devices may be effective, useful, and functional, they exemplify prior art devices which require expensive components.

Consequently, a need exists for a fire fighting monitor that is simple, lightweight, easy to build, yet effective.

SUMMARY OF THE INVENTION

The present invention is directed to a portable ground standing fire fighting monitor which satisfies the aforementioned needs by providing a simple, lightweight, easy to build, yet effective fire fighting appliance. The monitor of the present invention at least equals, and in some instances exceeds, the capabilities of prior art monitors that employ expensive, complex cast and machined components, by using only inexpensive, simple, lightweight sections of pipe and a simple ball bearing swivel joint. In this way, the monitor of the present invention reduces the costs associated with fire fighting and allows fire fighters to obtain a highly effective monitor at less cost which thereby promotes their ability to perform their important and socially beneficial task.

Accordingly, the present invention is directed to a portable ground standing fire fighting monitor which comprises: (a) a support platform for resting upon a surface; (b) a water gun including a curved discharge head having an outlet end and a length of curved flexible inlet tube having an inlet end; (c) first means for adjustably coupling the discharge head to the flexible inlet tube to undergo movement of the discharge head through a first predetermined arc extending in a generally side-to-side direction relative to the flexible inlet tube for aiming discharge stream flow from the discharge head in a generally horizontal plane; and (d) second means for adjustably coupling the flexible inlet tube to the support platform to undergo movement of the flexible inlet tube and the discharge head therewith through a second predetermined arc extending in a generally up-and-down direction relative to the support platform for aiming discharge stream flow from the discharge head in a generally vertical plane.

More particularly, the first coupling means includes a swivel joint coupling the discharge head to the flexible inlet tube for rotatable movement through the first predetermined arc, and a swivel handle pivotably mounted to the discharge head adjacent to the swivel joint. The second coupling means includes an inverted U-shaped bracket member mounted on the support platform and bridging over the flexible inlet tube, an elongated threaded member rotatably coupled to the flexible inlet tube at a lower end of the shaft and being threadably coupled to the U-shaped bracket member adjacent to an upper end of the threaded member such that selected rotation of the threaded member causes pivoting of the flexible inlet tube and discharge head through the second predetermined arc, an insert pivotally mounted to the support platform and rotatably mounting the lower end of the threaded member, and a crank member attached to the upper end of the threaded member and adapted to be gripped manually to rotate the threaded member. The first and second coupling means of the monitor permit the angle of the discharge stream flow to be adjusted vertically and horizontally, for example, up to about 45° in the vertical direction and about 30° in the horizontal direction.

The monitor further comprises a stream flow shaping element inserted in each of the outlet end of the discharge head and the inlet end of the flexible inlet tube. The stream flow shaping element has a pair of generally concentric inner and outer sleeves and a plurality of divider walls circumferentially spaced about and radially extending between and connected at opposite ends to the inner and outer sleeves so as to define a plurality of generally parallel internal flow channels through the stream flow shaping element. The monitor further comprises a plurality of elongated legs attached to the support platform to undergo pivotal movement relative thereto generally in a plane defined by the support platform between a stowed position and an extended position.

These and other features and advantages of the present invention will become apparent to those skilled in the art upon a reading of the following detailed description when taken in conjunction with the drawings wherein there is shown and described an illustrated embodiment of the invention.

BRIEF DESCRIPTION OF THE DRAWINGS

In the following detailed description, reference will be made to the attached drawings in which:

FIG. 1 is a perspective view of a portable ground standing fire fighting monitor in accordance with the present invention.

FIG. 2 is an enlarged top plan view of the monitor of FIG. 1.

FIG. 3 is a side elevational view of the monitor of FIG. 1.

FIG. 4 is an enlarged detailed view of the portion of the monitor enclosed in the circle 4 of FIG. 1, showing a reaction spike mounted on a bottom side of each of a plurality of elongated arms attached to the support platform.

FIG. 5 is an enlarged perspective view of one of a plurality of stream flow shaping elements employed by the monitor of FIG. 3.

FIG. 6 is an enlarged fragmentary perspective view of a corner of the support platform of FIG. 2, showing a T-shaped adustable support element.

DETAILED DESCRIPTION OF THE INVENTION

Referring to the drawings and particularly to FIGS. 1–3, there is illustrated a portable ground standing fire fighting monitor, generally designated 10, of the present invention shown in a typical operating position for projecting a stream of water over a considerable distance and at a substantial flowrate, for instance, exceeding 1000 gpm (gallons per minute) so as to effectively fight fires. Basically, the monitor 10 includes a support platform 12 adapted for resting upon a support surface, such as the ground surface, and a water gun 14 having a flexible inlet tube 16 and a discharge head 18. The flexible inlet tube 16 has opposite inlet and outlet ends 16A, 16B and preferably overall of a curved configuration of about 45°. In similar manner, the discharge head 18 has opposite inlet and outlet ends 18A, 18B and preferably overall of a curved configuration of about 90°.

More particularly, the support platform 12 of the monitor 10 includes a pair of opposite elongated side members 20, a pair of opposite elongated end members 22 extending between and rigidly interconnecting opposite ends of the side members 20, and a cross member 24 extending between and rigidly interconnecting middle portions of the side members 20. The interconnected side members 20, end members 22, and cross member 24 extend in a common plane.

Referring to FIGS. 1–4 and 6, in order to stabilize the support platform 12 to remain in a stationary position and resist movement in a rearward direction due to the reaction force generated by the forwardly-projected water stream emanating from the discharge head 18 of the water gun 14, the monitor 10 also includes a pair of front support pins 26 and a pair of rear support legs 28. Each front support pin 26 has an upright externally threaded portion 26A and an upper transverse handle portion 26B rigidly attached to the upper end of the upright threaded portion, providing the pin 26 with a generally T-shaped configuration. The externally threaded portions 26A of the pins 26 are threadably inserted through internally threaded holes 30 formed in the pair of laterally spaced front corners 32 of the support platform 12 and into the ground underlying the support platform 12 for thereby anchoring the support platform 12 to the ground surface.

Referring to FIGS. 1–3, the rear support legs 28 have clevises 34 defined at inner ends by which the support legs 28 are pivotally attached to the pair of laterally spaced rear corners 36 of the support platform 12. With such arrangement, the support legs 28 can undergo pivotal movement relative to the support platform 12 generally in the common plane defined by the support platform 12 between stowed positions in which the legs 28 lie alongside the side members 20 of the support platform 12 and extended positions, as seen in FIGS. 1 and 2, in which the legs 28 extend outwardly therefrom.

Referring to FIGS. 1 and 4, the support legs 28 also have a plurality of reaction spikes 38 adapted to dig into the ground being attached to and extending downwardly and outwardly from respective bottom surfaces 28A of the legs 28. The support legs 28 also have elongated locking rods 40, being shorter in length than the respective legs 28, which detachably interconnect with the legs 28 and the rear end member 22 of the support platform 12.

Referring to FIGS. 1–3, the monitor 10 also includes first means 42 for adjustably coupling the inlet end 18A of the discharge head 18 to the outlet end 16B of the flexible inlet tube 16 so that the discharge head 18 can undergo rotational movement relative to the inlet tube 16 through a first predetermined arc H, such as preferably about 30°, extending in a generally side-to-side direction relative to the flexible inlet tube 16 for aiming the discharge stream flow from the discharge head 18 in a generally horizontal plane. The first coupling means 42 includes a watertight ball-bearing type swivel joint 44 coupling the discharge head to the flexible inlet tube for undergoing the rotatable movement through the first predetermined arc H.

Also, the first coupling means 42 includes a swivel handle 46 pivotably mounted to the discharge head adjacent to the swivel joint 44. The swivel handle 46 pivotably mounted to the discharge head 18 adjacent to the swivel joint 44 permits the operator to rotate the discharge head 18 and adjust the angle of the discharge water stream (not shown) in the horizontal direction.

Referring again to FIGS. 1–3, the monitor 10 further includes second means 48 for adjustably coupling the flexible inlet tube 16 of the water gun 14 upon the support platform 12 so that the flexible inlet tube 16 and the discharge head 18 therewith can undergo movement relative to the support platform 12 through a second predetermined arc V, such as preferably about 45°, extending in a generally up-and-down direction relative to the support platform 12 for aiming the discharge stream flow from the discharge head 18 in a generally vertical plane. The second coupling means 48 includes an inverted U-shaped bracket assembly 50, an elongated threaded member or rod 52, a ball joint connector 54, and a crank wheel 56.

The bracket assembly 50 is mounted on the support platform 12 and bridges over the flexible inlet tube 16. The bracket assembly 50 has a primary support member 58 and a pair of secondary support members 60. The primary support member 58 has a pair of side legs 62 and a top leg 64 extending between and interconnecting the upper ends of the side legs 62. The top leg 64 can rotate about end pivots 64A relative to the upper ends of the side legs 62. The lower ends of side legs 62 are connected at 66 to the cross member 24 of the support platform 12. The top leg 64 of the primary support member 58 has a internally threaded hole 68 defined substantially at the center of the top leg 64. The secondary support members 60 are connected at 70 to the respective side legs 62 of the primary support member 58. The threaded rod 52 is rotatably coupled at a lower end by the ball joint connector 54 to the flexible inlet tube 16 and is threadably coupled to the top leg 64 of the bracket member 50 through the threaded hole 68 therein such that selected rotation of the threaded rod 52 will cause pivoting of the flexible inlet tube 16 and of the discharge head 18 therewith in the vertical direction through the second predetermined arc V relative to the support platform 12. The crank wheel 56 attached to the upper end of the threaded rod 52 is adapted to be gripped manually to rotate the threaded rod 52. Depending upon which direction the crank wheel 56 is turned, the threaded rod 52 either extends or retracts relative the top leg 64 of the primary support member 58 of the bracket assembly 50, thereby adjusting the elevation of inlet tube 16 of the water gun 14 through the second predetermined arc V.

The monitor 10 also includes third means 72 for pivotally coupling the flexible inlet tube 16 at the inlet end 16A thereof to the support platform 12 to undergo pivotal movement of the flexible inlet tube 16 at the inlet end 16A about a generally horizontal axis relative to the support platform 12. The third coupling means 72 includes an elongated tubular sleeve 74 and a bracket 76 extending over the inlet end 16A of the flexible inlet tube 16 and fixedly attached to opposite ends of the sleeve 74 and to the inlet end of the flexible inlet tube 16, and a pivot pin 78 attached to the support platform 12 and rotatably mounting the sleeve 74 about the horizontal axis.

Still further, the monitor 10 includes a stream shaping element 80 which functions to keep the water stream intact and not let it break up as it passes through the water gun 14. The stream shaping element 80 is inserted in each of the outlet end 18B of the discharge head 18 and the inlet end 16A of the flexible inlet tube 16. The stream shaping element 80 has a pair of concentric cylindrical inner and outer sleeves or walls 82, 84 and a plurality of divider walls 86 circumferentially spaced about and radially extending between and connected at opposite ends to the inner and outer tubes 82, 84 so as to define a plurality of generally parallel honeycomb-shaped internal flow channels 88 through the stream shaping element 80. The stream shaping element 80 also has external threads 90 at one end thereof which are received by a threaded portion (not shown) of the inside surface of the inlet tube 16 and discharge head 18.

As can be readily understood by those skilled in the art from the foregoing description, the monitor 10 provides vertical and horizontal directional control along with a well controlled water stream. The crank wheel 56 is used for vertical adjustment as explained above and the above described swivel handle 46 and swivel joint 44 provide adjustment in the horizontal direction. The above described stream shaping elements 80 reduce the degree of turbulence in the discharge stream thereby enabling the water gun 14 to project a well controlled stream of water. Accordingly, by employing relatively simple and inexpensive components, the monitor 10 of the present invention, provides an inexpensive, portable, yet effective water projecting fire fighting monitor.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. A portable ground standing fire fighting monitor comprising:

(a) a support platform for resting upon a support surface;

(b) a water gun including a discharge head having an outlet end and a length of flexible inlet tube having an inlet end;

(c) first means for adjustably coupling said discharge head to said flexible inlet tube to undergo movement of said discharge head relative to said flexible inlet tube through a first predetermined arc extending in a generally side-to-side direction relative to said flexible inlet tube for aiming discharge stream flow from said outlet end of said discharge head in a generally horizontal plane; and (d) second means for adjustably coupling said flexible inlet tube to said support platform to undergo movement of said flexible tube and said discharge head therewith relative to the support platform through a second predetermined arc extending in a generally up-and-down direction relative to said support platform for aiming the discharge flow from said outlet end of said discharge head in a generally vertical plane.

2. The monitor of claim 1 further comprising:

a plurality of elongated legs attached to said support platform and extending outwardly therefrom.

3. The monitor of claim 2 wherein said legs having a plurality of reaction spikes attached to and extending downwardly and outwardly from respective bottom surfaces of said legs.

4. The monitor of claim 1 further comprising:

at least a pair of T-shaped adjustable support pins threadably inserted through spaced peripheral portions of said support platform and into the support surface below said support platform for anchoring said support platform to the support surface, each support pin including an upright threaded portion and an upper transverse handle portion.

5. The monitor of claim 1 wherein said first coupling means is a swivel joint coupling said discharge head to said flexible inlet tube for rotatable movement through said first predetermined arc.

6. The monitor of claim 5 wherein said first coupling means also includes a swivel handle pivotably mounted to said discharge head adjacent to said swivel joint.

7. The monitor of claim 5 wherein said first predetermined arc is about 30°.

8. The monitor of claim 1 wherein said second coupling means includes:

an inverted U-shaped bracket assembly mounted on said support platform and bridging over said flexible inlet tube; and an elongated threaded member rotatably coupled to said flexible inlet tube at a lower end of said threaded member and being threadably coupled to said U-shaped bracket assembly adjacent to an upper end of said threaded member such that selected rotation of said threaded member causes pivoting of said flexible inlet tube and said discharge head through said second predetermined arc.

9. The monitor of claim 8 wherein said second coupling means also includes a ball joint connector rotatably coupling said lower end of said threaded member to said flexible inlet tube.

10. The monitor of claim 8 wherein said second coupling means also includes a crank member attached to said upper end of said threaded member adapted to be gripped manually to rotate said threaded member.

11. The monitor of claim 8 wherein said second predetermined arc is equal to about 45°.

12. The monitor of claim 1 further comprising:

third means for pivotally coupling said flexible tube at said inlet end thereof to said support platform to undergo movement of said flexible inlet tube at said inlet end about a generally horizontal axis relative to said support platform.

13. The monitor of claim 12 wherein said third pivotally coupling means includes:

an elongated sleeve and a bracket extending between and fixedly attached to opposite ends of said sleeve and extending over said inlet end of said flexible inlet tube; and a pivot pin attached to said support platform and rotatably mounting said sleeve about said horizontal axis.

14. The monitor of claim 1 wherein said support platform includes a pair of elongated side members, a pair of elongated end members extending between and rigidly interconnecting opposite ends of said side members, and a cross member extending between and rigidly interconnecting middle portions of said side members.

15. The monitor of claim 1 further comprising:

a stream shaping element inserted in each of said outlet end of said discharge head and said inlet end of said flexible inlet tube, each said stream shaping element having a pair of concentric inner and outer sleeves and a plurality of divider walls circumferentially spaced about and radially extending between and connected at opposite ends to said inner and outer sleeves so as to define a plurality of generally parallel internal flow channels through said stream shaping element.

16. A portable ground standing fire fighting monitor comprising:

(a) a support platform for resting upon a ground surface;

(b) a water gun including a curved discharge head having an outlet end and a length of curved flexible inlet tube having an inlet end;

(c) first means for adjustably coupling said discharge head to said flexible inlet tube to undergo movement of said discharge head relative to said flexible inlet tube through a first predetermined arc extending in a generally side-to-side direction relative to said flexible inlet tube for aiming discharge stream flow from said discharge head in a generally horizontal plane, said first coupling means including (i) a swivel joint coupling said discharge head to said flexible inlet tube for rotatable movement through said first predetermined arc, and (ii) a swivel handle pivotably mounted to said discharge head adjacent to said swivel joint; and (d) second means for adjustably coupling said flexible inlet tube to said support platform to undergo movement of said flexible inlet tube and said discharge head therewith relative to said support platform through a second predetermined arc extending in a generally up-and-down direction relative to said support platform for aiming the discharge stream flow from said discharge head in a generally vertical plane, said second coupling means including (i) an inverted U-shaped bracket assembly mounted on said support platform and bridging over said flexible inlet tube, (ii) an elongated threaded member rotatably coupled to said flexible inlet tube at a lower end of said threaded member and being threadably coupled to said U-shaped bracket assembly adjacent to an upper end of said threaded member such that selected rotation of said threaded member causes pivoting of said flexible inlet tube and said discharge head through said second predetermined arc, (iii) a ball joint connector rotatably coupling said lower end of said threaded member to said flexible inlet tube, and (iv) a crank member attached to said upper end of said threaded member adapted to be gripped manually to rotate said threaded member.

17. The monitor of claim 16 wherein said first predetermined arc is equal to about 30°.

18. The monitor of claim 16 wherein said second predetermined arc is equal to about 45°.

19. The monitor of claim 16 further comprising:

a stream shaping element inserted in each of said outlet end of said discharge head and said inlet end of said flexible inlet tube, each said stream shaping element having a pair of concentric inner and outer sleeves and a plurality of divider walls circumferentially spaced about and radially extending between and connected at opposite ends to said inner and outer sleeves so as to define a plurality of generally parallel internal flow channels through said stream shaping element.

20. The monitor of claim 16 further comprising:

a plurality of elongated legs attached to said support platform and extending outwardly therefrom.

* * * * *